United States Patent [19]

Nakamine et al.

[11] 4,236,486

[45] Dec. 2, 1980

[54] TONER CONCENTRATION CONTROL DEVICE

[75] Inventors: Chosin Nakamine, Yokohama; Norihito Fuzii, Kawasaki, both of Japan

[73] Assignee: Tokyo Shibaura Denki Kabushiki Kaisha, Kawasaki, Japan

[21] Appl. No.: 22,178

[22] Filed: Mar. 20, 1979

[30] Foreign Application Priority Data

Mar. 27, 1978 [JP] Japan ..... 53-39190[U]

[51] Int. Cl.[3] ..... B05C 11/00; G03G 15/00

[52] U.S. Cl. ..... 118/691; 356/38; 356/244

[58] Field of Search ..... 118/691, 689, 690; 222/DIG. 1; 427/8; 356/38, 244

[56] References Cited

U.S. PATENT DOCUMENTS 3,399,652 9/1968 Gawron ..... 118/691

3,897,748 8/1975 Hirata et al. ..... 118/691

3,911,861 10/1975 Griesmer ..... 118/691

*Primary Examiner*—Evan K. Lawrence

*Attorney, Agent, or Firm*—Cushman, Darby and Cushman

[57] ABSTRACT

A toner concentration control device comprises a toner supply mechanism for supplying a toner to a developing device, a probe for picking up the toner in the developing agent after development is effected and a control mechanism for controlling the toner supply mechanism. The probe has parallel grooves on the outer peripheral surface thereof which constitute a toner pickup surface. An amount of toner picked up is optically detected and the control mechanism controls the toner supply mechanism based on the result of detection. By so doing, an amount of fresh toner corresponding to an amount of toner spent by development is supplied from the toner supply mechanism to a developing agent in the developing device to maintain constant the toner concentration in the developing agent in the developing device.

8 Claims, 8 Drawing Figures

TONER CONCENTRATION CONTROL DEVICE

BACKGROUND OF THE INVENTION

I. Field of the Invention

This invention relates to a toner concentration control device for controlling the concentration of a toner in a powdery developing agent as used in an elctrophotographic copying machine so that it is maintained constant.

II. Description of the Prior Art

In an electrophotographic copying machine using a developing agent comprising a toner and carrier, "fogging" occurs when the concentration of a toner in the developing agent becomes higher than a predetermined value. This is because the toner is deposited onto the white portion of an image. Furthermore, there sometimes occurs the case where a mix of the toner and carrier ceases to function as a developing agent when used for a prolonged time period. When, on the other hand, the concentration of the toner is lowered an image as a whole becomes light or pale, failing to faithfully reproduce an original image. For this reason, it is necessary to maintain always constant the concentration of a toner in the developing agent.

U.S. Pat. No. 3,897,748 discloses a method in which an amount of fresh toner corresponding to an amount of toner spent by development is supplied into a developing agent. In this method, a developer (a toner/carrier mix) after development is contacted with a rotating cylindrical probe, made of an electroconductive material, to cause the toner and carrier to be separated from each other to permit only the toner to be picked up by the probe. An amount of toner picked up by the probe corresponds to the concentration of the toner in the developing agent after development.

The amount of toner picked up by the probe is detected by an optical means and an amount of fresh toner corresponding to the amount of toner spent by development is supplied by a toner supply device. According to the method of this patent the concentration of the toner in the developing agent can be automatically maintained always constant.

In this method, however, the toner pickup probe has its surface mirror-finished and it is cumbersome to manufacture. Moreover, it is difficult to maintain the surface state of the probe constant over a longer period of usage. As a result, an amount of toner picked up by the probe does not correspond to the concentration of the toner in the developing agent. It is thus difficult to always maintain a stable and accurate toner concentration.

SUMMARY OF THE INVENTION

It is accordingly an object of this invention to provide a toner concentration control device which can stably and accurately control the concentration of toner of a developing agent over a lengthy time period.

According to this invention there is provided a toner concentration control device comprising supplying means for supplying a fresh toner to a developing device for causing an electrostatic image on the surface of a photosensitive body to be developed by a magnetic brush of a developing agent comprising a toner and a carrier; probe means adapted to be rotated in contact with the magnetic brush after development and having on the outer peripheral surface thereof a nonmagnetic electroconductive surface for picking up the toner from the magnetic brush, the electroconductive surface of said probe means having a plurality of parallel grooves provided in a direction of rotation of said probe to provide a toner pickup surface; detecting means for optically detecting an amount of toner picked up on the toner pickup surface of said probe to produce a corresponding signal; and means for comparing the signal from said detecting means with a reference value and controlling an amount of fresh toner from said supplying means to maintain constant a toner concentration in the developing agent in said developing device.

DESCRIPTION OF THE PREFERRED EMBODIMENTS

Figure 1:
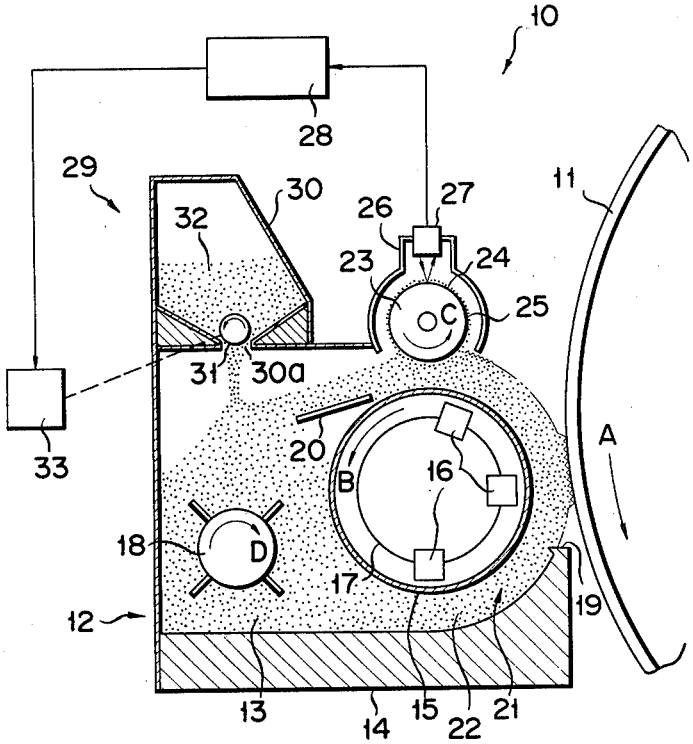
FIG. 1 is a cross-sectional view showing a developing mechanism of an electrophotographic copying machine including a toner concentration control device according to this invention.

FIG. 1 shows a developing mechanism of an electrophotographic copying machine incorporating a toner concentration control device 10 according to this invention. Reference numeral 11 shows a photosensitive body, such as photosensitive drum, which is rotated in a direction indicated by an arrow A in FIG. 1. An electrostatic latent image is formed by an exposure section (not shown) on the surface of the photosensitive drum 11. Opposed to the drum 11, a developing device 12 has a bottom 14 of a receptacle in which a developing agent 13 consisting of a toner and a carrier such as iron powder is received. Within the receptacle a sleeve 15 formed of nonmagnetic material is located near to the photosensitive drum and an agitator 18 is positioned to agitate the developing agent 13. The sleeve 15 is rotated in a direction indicated by an arrow B in FIG. 1 and the agitator is rotated in a direction indicated by an arrow D in FIG. 1. A path for a magnetic brush 21 to be explained later is formed between the sleeve 15 and the bottom 14 of the receptacle. Within the sleeve 15 is disposed a core bar on the outer peripheral surface of which permanent magnets 16 are mounted.

In operation the photosensitive drum 11 bearing an electrostatic latent image and sleeve 15 are rotated. During the rotation of drum 11 the developing agent 13 is attracted under the action of the permanent magnets 16 toward the surface of the sleeve 15 and is moved as a magnetic brush 21 in the direction of arrow B in which the sleeve 15 rotated. The magnetic brush 21 passes through the path 22 and regulated by a doctor blade 19 on the base of the receptacle to have a thickness suitable for development. Then, the magnetic brush is slidably contacted with the surface of the photosensitive drum 11 to cause the toner in the magnetic brush to be deposited onto the electrostatic latent image on the surface of the photosensitive drum 11. In this way, the developing operation is completed. Thereafter, the magnetic brush on the surface of the sleeve 15 is scraped by a scraper 20 away from the surface of the sleeve 15. The scraped developing agent, after being fully agitated by the agitator 18, is again used for a magnetic brush 21.

Above the sleeve 15 a disc-like probe 23 is provided such that it is contacted at a predetermined depth with the magnetic brush 21 on the sleeve 15. The probe 23 is rotated, normally or as required, by a drive mechanism (not shown) in a direction as indicated by an arrow C in FIG. 1. The probe is made of an electroconductive, nonmagnetic material and has a toner pickup surface 24 on the outer peripheral surface thereof as will be later explained below.

As already set out above, the magnetic brush leaving the surface of the photosensitive drum 11 after development moves along the sleeve 15, and is contacted with the rotating probe 23 a little before it reaches the scraper 20. Upon contact with the probe 23 the toner and carrier which have been electrostatically attracted to each other are separated from each other. Only the separated toner is deposited onto the toner pickup surface 24 of the probe 23. The amount of toner deposited is substantially proportional to the toner concentration in the developing agent leaving the surface of the photosensitive drum 11 after development. The amount of toner 15 on the toner pickup surface 24 of the probe 23 is optically detected by a detector 27 which is disposed on a cover 26 for covering the probe 23 except for its underside such that it is located opposite to the toner pickup surface of the probe. The detector 27 comprises a light source such as a light emitting diode, an optical system for directing a light from the light source to the toner pickup surface of the probe 23, a light receiving element for receiving a light reflected from the toner pickup surface through an optical system and converting it to a corresponding electrical signal. The toner 25 on the toner pickup surface 24 of the probe 23 is moved directly below the detector 27 during the rotation of the probe 23 and at that place the light from the light source illuminates the toner pickup surface 24 of the probe through the optical system The toner pickup surface 24 of the probe reflects a light corresponding to an amount of toner deposited there. The reflected light is received by the light receiving element through the optical system and converted to a corresponding electrical signal.

The converted electrical signal is supplied to a control mechanism 28. The control mechanism 28 amplifies the above-mentioned electrical signal, compares it with a predetermined reference value to produce a control signal. An amount of fresh toner to be supplied to the developing agent is controlled by the control signal from the control mechanism 28. That is, a hopper 30 is disposed on the control device 10 and has a toner supply opening 30*a* at the bottom thereof. A supply roller 31 blocks the toner supply opening 30*a* of the hopper and feed a fresh toner toward the developing agent in the receptacle when it is rotated by a drive mechanism 33. The hopper 30, supply roller 31 and drive mechanism 33 constitutes a toner supply device 29. The drive mechanism 33 and thus the supply roller 31 are controlled by the control signal. By so doing, a fresh toner in an amount corresponding to the amount of the toner spent by development is added to the developing agent in the receptacle to maintain the toner concentration in the developing agent 13 always constant.

Figure 2A:
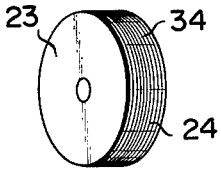
FIG. 2A is a perspective view showing a probe according to this invention.
Figure 2B:
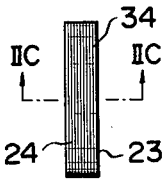
FIG. 2B is a side view showing the probe of FIG. 2A.
Figure 2C:
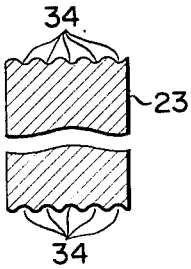
FIG. 2C is an enlarged cross-sectional view, taken along line IIC—IIC of FIG. 2B.

In the toner concentration control device so constructed, the probe 23 according to one embodiment of this invention is made of an electroconductive, nonmagnetic material such as aluminum and has a plurality of parallel grooves 34 on the entire outer peripheral portion thereof and in a direction of rotation of the probe 23, as shown in FIGS. 2A to 2C. The outer peripheral surface of the probe 23 which includes the surface of the grooves 34 provides the toner pickup surface 24. In one form of probe, the depth of grooves 34 is of the same order as the diameter of toner particles and normally 3 to 5 $\mu$m, and the pitch of the grooves is about 6 $\mu$m. The formation of such grooves permits the toner particles in the developing agent to be picked up such that the particles are received in the grooves 34 when the developing agent in the form of the magnetic brush leaving the photosensitive drum 11 after development is contacted with the probe 23. The picked toner particles are positively carried to the detection section without being dropped away from the toner pickup surface of the probe 23. After detection, the toner particles deposited on the toner pickup surface of the probe 23 can be readily removed by a stream of magnetic brush moving in a direction of arrow B.

The toner pickup surface can be readily lathefinished at a lower cost than it is mirror-finished. Since the parallel grooves 34 of the probe 23 run in the direction of rotation of the probe 23, the toner pickup surface 24 is maintained relatively constant though it contacts directly with the magnetic brush leaving the surface of the photosensitive drum 11 after development and, in addition thereto, it has also the function of providing a uniform reflection light when an illuminating light from the light source is reflected. Thus, the probe 23 exhibits a uniform characteristic.

Figure 3A:
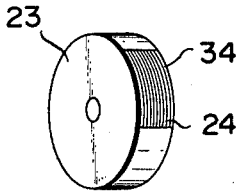
FIG. 3A is a perspective view showing another form of probe according to this invention.
Figure 3B:
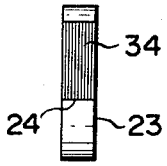
FIG. 3B is a side view showing the probe of FIG. 3A.

Another form of probe as shown in FIGS. 3A to 3B has a toner pickup surface 24 confined to a portion of the outer peripheral surface thereof with grooves run in the direction of arrow C in FIG. 1.

A still another form of probe is hollow-cylindrical in shape and the outer peripheral surface of the hollow-cylindrical probe includes a transparent toner pickup surface made of, for example, Nesa glass. In this case, a light receiving element is disposed within the hollow-cylindrical probe and a light emitting element is disposed outside the probe. A light transmitted through the transparent toner pickup surface of the probe is received or detected by the light receiving element. In this way, an amount of toner deposited on the probe can be detected.

Figure 4A:
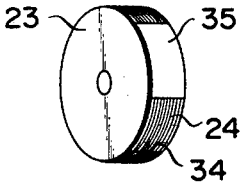
FIG. 4A is a perspective view showing a still another form of probe according to this invention.
Figure 4B:
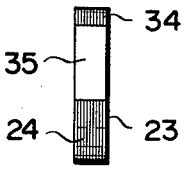
FIG. 4B is a side view showing the probe of FIG. 4A.

A still another form of probe as shown in FIGS. 4A and 4B has a reference surface portion 35 on the outer peripheral surface thereof. The reference surface portion 35 is obtained by coating the portion of the outer peripheral surface of the probe with a material to which no toner particles are attached. The remaining surface portion provides a toner pickup surface 24. In this case, the detector 27 sequentially detects the reflection light levels of the toner pickup surface and reference surface of the probe to produce corresponding measured and reference signals respectively. The control mechanism 28 compares the measured signal with the reference signal and as a result of comparison controls the drive mechanism 33.

According to this invention, the toner pickup surface of the probe is formed by providing parallel grooves in a direction of rotation of the probe. By so doing, the probe exhibits a uniform characteristics, and toner particles can be separated, and picked up, from the developing agent stably over a longer period of time. Such probe can be easily manufactured at lower cost. As a result, a toner concentration control device can be obtained which can always stably and accurately control the toner concentration.

What we claim is:

1. A toner concentration control device comprising:

supplying means for supplying a fresh toner to a developing device for causing an electrostatic image on the surface of a photosensitive body to be developed by a magnetic brush of a developing agent comprising a toner and a carrier;

probe means adapted to be rotated in contact with the magnetic brush after development and having on the outer peripheral surface thereof an electroconductive nonmagnetic surface for picking up the toner from the magnetic brush, the electroconductive surface of said probe means having a plurality of parallel grooves provided in a direction of rotation of said probe to provide a toner pick up surface;

detecting means for optically detecting an amount of toner picked up on the toner pick up surface of said probe to produce a corresponding signal; and means for comparing the signal from said detecting means with a reference value and controlling an amount of fresh toner from said supplying means to maintain constant a toner concentration in the developing agent in said developing device.

2. A device according to claim 1 in which said probe means is cylindrical in shape and has the toner pickup surface on the outer peripheral surface thereof.

3. A device according to claim 2 in which the toner pickup surface is confined to a portion of the outer peripheral surface of said probe means.

4. A device according to claim 2 in which the toner pickup surface is formed on the entire outer peripheral surface of said probe.

5. A device according to claim 4 in which said detecting means comprises a light emitting element for emitting light to the toner pickup surface and a photoelectric element for receiving the light reflected on the toner pickup surface and converting it to an electrical signal.

6. A device according to claim 2 in which said toner pickup surface of said probe is transparent.

7. A device according to claim 6 in which said detecting means comprises a light emitting element for emitting light to the toner pickup surface of said probe, and a photoelectric element disposed within said probe to receive the light from said light emitting element which has been transmitted through the toner pickup surface of said probe, to cause it to be converted to an electrical signal.

8. A device according to claim 1 in which said toner supply means comprises a hopper for receiving the toner and having a toner supply opening provided in the bottom thereof, a roller disposed within a hopper in a manner to block the toner supply opening and adapted to feed the fresh toner to the developing device by rotation thereof through said opening, and a drive mechanism for driving said roller.

* * * * *